US008348062B2

(12) United States Patent
Guen

(10) Patent No.: US 8,348,062 B2
(45) Date of Patent: Jan. 8, 2013

(54) PACKAGING BOX

(75) Inventor: Minhyung Guen, Yongin-si (KR)

(73) Assignee: SB LiMotive Co., Ltd., Yongin-si (KR)

( * ) Notice: Subject to any disclaimer, the term of this patent is extended or adjusted under 35 U.S.C. 154(b) by 0 days.

(21) Appl. No.: 13/086,306

(22) Filed: Apr. 13, 2011

(65) Prior Publication Data

US 2012/0091191 A1 Apr. 19, 2012

(30) Foreign Application Priority Data

Oct. 18, 2010 (KR) ..... 10-2010-0101457

(51) Int. Cl.
*B65D 85/00* (2006.01)
*B65D 21/02* (2006.01)
*B65D 5/38* (2006.01)

(52) U.S. Cl. ..... 206/703; 220/23.87; 229/125.125

(58) Field of Classification Search ..... 206/703–705, 206/738, 739, 804; 229/122, 125.125; 220/23.87, 220/345.1, 503, 504
See application file for complete search history.

(56) References Cited

U.S. PATENT DOCUMENTS

| | | | | | |
|---|---|---|---|---|---|
| 63,104 | A | * | 3/1867 | Schoerken | 229/125.125 |
| 228,158 | A | * | 5/1880 | Woods | 229/125.125 |
| 339,420 | A | * | 4/1886 | Hubbard et al. | 220/503 |
| 855,045 | A | * | 5/1907 | Cook | 229/122 |
| 1,597,652 | A | * | 8/1926 | Kadan | 229/125.125 |
| 1,823,572 | A | * | 9/1931 | Reed | 229/125.125 |
| 1,937,222 | A | * | 11/1933 | Gallahan | 206/804 |
| 1,991,425 | A | * | 2/1935 | Sherman | 229/125.125 |
| 2,001,561 | A | * | 5/1935 | Anglin | 229/125.125 |
| 2,522,768 | A | * | 9/1950 | Wiepert | 220/23.87 |
| 3,389,847 | A | * | 6/1968 | Darot | 229/125.125 |
| 3,858,717 | A | * | 1/1975 | Peters | 206/738 |
| 4,390,217 | A | * | 6/1983 | Wagner | 220/503 |
| 4,844,279 | A | * | 7/1989 | Chalat | 220/504 |
| 5,836,455 | A | * | 11/1998 | Connor et al. | 206/757 |
| 5,860,589 | A | | 1/1999 | Hsu | |
| 5,996,794 | A | * | 12/1999 | Popovich | 206/425 |
| 6,386,368 | B1 | * | 5/2002 | Pirro | 206/738 |

FOREIGN PATENT DOCUMENTS

| | | | |
|---|---|---|---|
| JP | 1994-016301 | U | 3/1994 |
| KR | 89-6844 | U | 5/1989 |
| KR | 10 2001-0111961 | A | 12/2001 |
| KR | 20-2008-0001286 | U | 5/2008 |

OTHER PUBLICATIONS

KIPO Office action dated Apr. 16, 2012, for Korean priority Patent application 10-2010-0101457, (3, pages).

* cited by examiner

*Primary Examiner* — Bryon Gehman
(74) *Attorney, Agent, or Firm* — Christie, Parker & Hale, LLP

(57) ABSTRACT

A packaging box, which is easily disassembled to easily remove a product therefrom. A packaging box including an external box having a receiving space therein, the external box including a receiving part and a cover removably coupleable to the receiving part; an internal box receivable in the receiving space of the external box, the internal box having a receiving space therein; and a slide pad slidably coupleable to a lower portion of the internal box.

13 Claims, 8 Drawing Sheets

PACKAGING BOX

CROSS-REFERENCE TO RELATED APPLICATION

This application claims priority to and the benefit of Korean Patent Application No. 10-2010-0101457, filed in the Korean Intellectual Property Office on Oct. 18, 2010, the entire content of which is incorporated herein by reference.

BACKGROUND

1. Field

Aspects of embodiments of the present invention relate to a packaging box.

2. Description of the Related Art

Generally, battery cells are packaged by coupling end plates formed of aluminum and disposed on both ends of the battery cell to a rod and bolt for considerations of safety. Also, each of the battery cells is typically individually packaged in a case, which is called a holder, formed of a polyethylene terephthalate (PET) material. Thus, it takes a long time to package the battery cells, and also, material costs and the expenses of carriage are increased. Therefore, a packaging material for easily packaging the battery cells and reducing the material costs and the expenses of carriage is needed.

SUMMARY

According to an aspect of embodiments of the present invention, a packaging box may be easily disassembled to easily remove battery cells therefrom.

According to one embodiment of the present invention, a packaging box includes: an external box having a receiving space therein, the external box including a receiving part and a cover removably coupleable to the receiving part; an internal box receivable in the receiving space of the external box, the internal box having a receiving space therein; and a slide pad slidably coupleable to a lower portion of the internal box.

In one embodiment, a packaging box further includes a guide arranged in the internal box and including a plurality of partitions, and a product is received into the guide. The product may include a battery cell.

The internal box may include a body and an internal cover covering an open upper side of the body, the body and the internal cover being integrally formed.

The internal cover may include a first surface connected to a rear surface of the body and covering the open upper side of the body; and a second surface connected to the first surface and covering a front surface of the body opposite the rear surface.

An opening may be defined in a lower surface of the body opposite the open upper side.

The internal cover may include a wing part coupled to a side surface of the body, and a wing gap may be defined in the body, the wing part being insertable in the wing gap.

A pad gap may be defined in the body, the slide pad being removably insertable in the pad gap.

In one embodiment, the slide pad includes a first surface slidably coupleable to the lower portion of the internal box; and a second surface coupled to a front surface of the internal box, and a handle hole is defined in the second surface.

According to another embodiment of the present invention, a packaging box includes: an external box having a receiving space therein, the external box including a receiving part and a cover removably coupleable to the receiving part; an internal box receivable in the receiving space of the external box, the internal box having a receiving space therein; and at least one dotted line on a front surface and a bottom surface of the internal box.

In one embodiment, a packaging box further includes a guide arranged in the internal box and including a plurality of partitions, and a product is received into the guide. The product may include a battery cell.

The internal box may include a body and an internal cover covering an open upper side of the body, the body and the internal cover being integrally formed.

The internal cover may include a first surface connected to a rear surface of the body and covering the open upper side of the body; and a second surface connected to the first surface and covering a front surface of the body opposite the rear surface.

The internal cover may include a wing part coupled to a side surface of the body, and a wing gap may be defined in the body, the wing part being insertable in the wing gap.

BRIEF DESCRIPTION OF THE DRAWINGS

The above and other features and advantages will become more apparent to those of ordinary skill in the art by describing in detail some exemplary embodiments of the present invention with reference to the attached drawings, which are incorporated in and constitute a part of this specification. The drawings illustrate some exemplary embodiments of the present disclosure and, together with the description, serve to explain principles of the present invention.

DETAILED DESCRIPTION

Some exemplary embodiments of the present invention will be described more fully hereinafter with reference to the accompanying drawings; however, embodiments of the present invention may be embodied in different forms and should not be construed as limited to the exemplary embodiments illustrated and set forth herein. Rather, these exemplary embodiments are provided by way of example for understanding of the invention and to convey the scope of the invention to those skilled in the art. As those skilled in the art would realize, the described embodiments may be modified in various ways, all without departing from the spirit or scope of the present invention.

Figure 1:
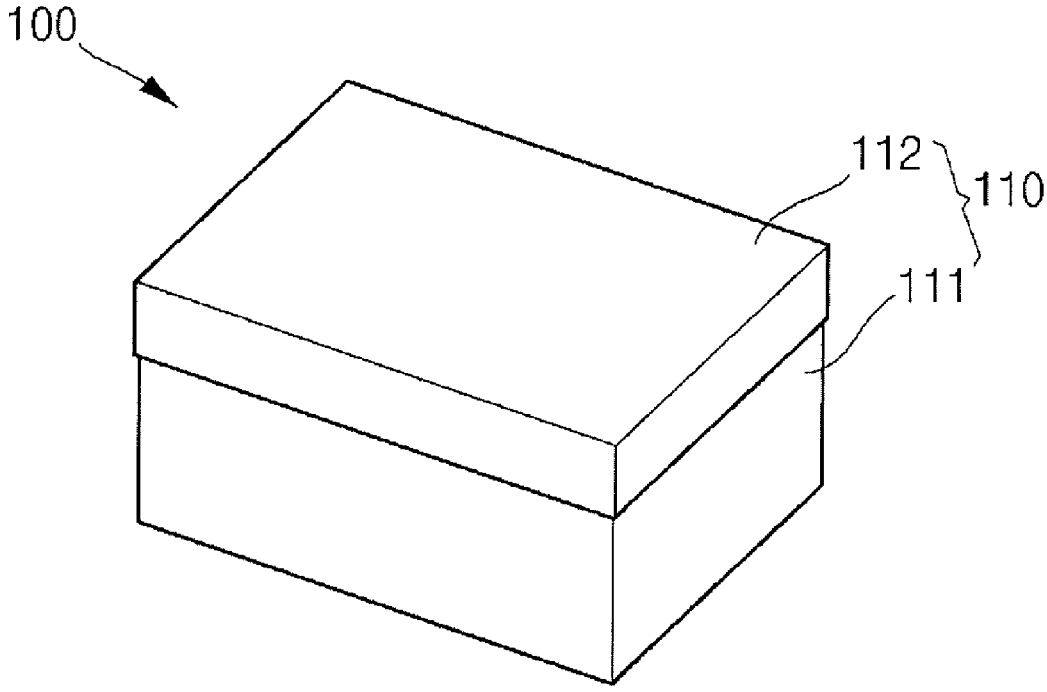
FIG. 1 is a perspective view of a packaging box according to an embodiment of the present invention.
Figure 2:
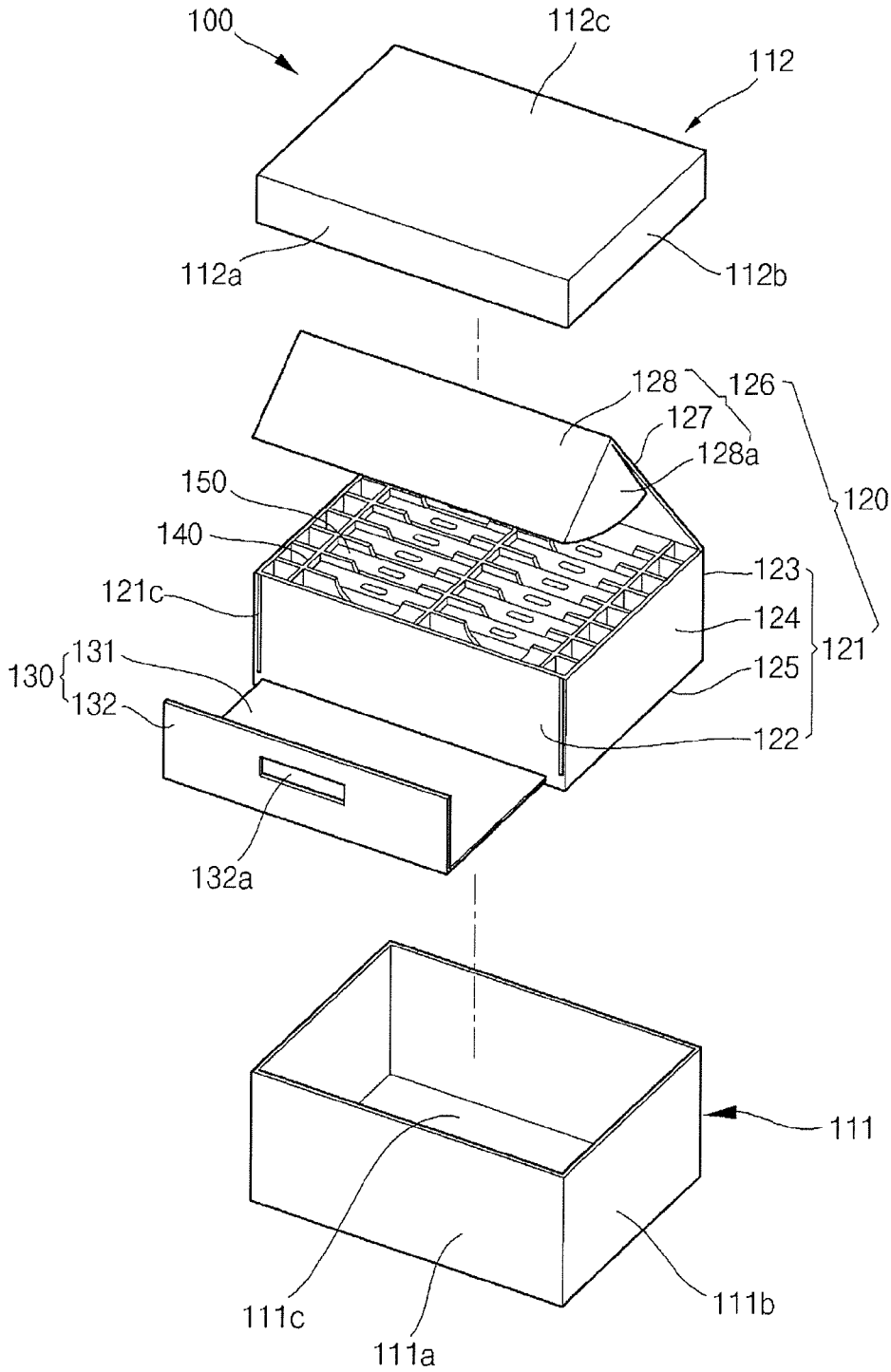
FIG. 2 is an exploded perspective view of the packaging box of FIG. 1.
Figure 3:
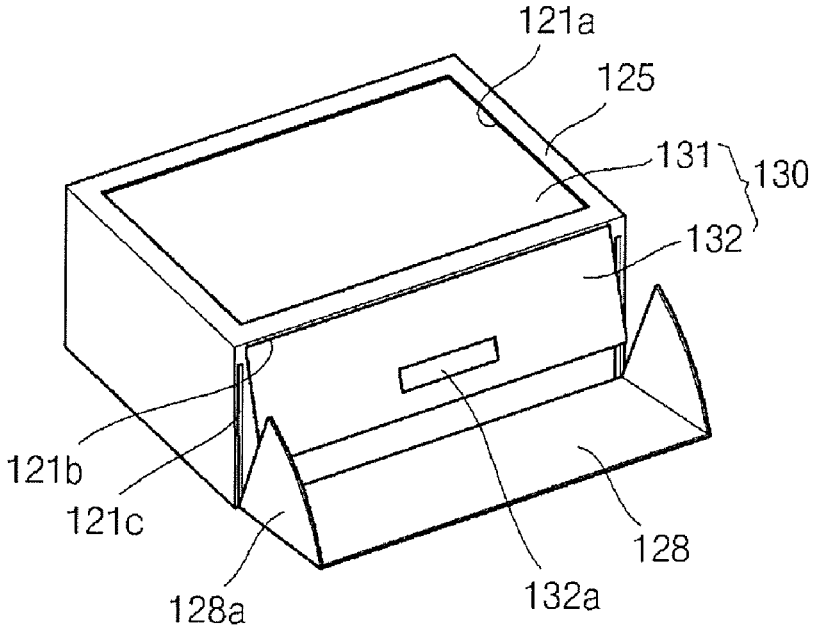
FIG. 3 is a bottom perspective view of an internal box and a slide pad of the packaging box of FIG. 1.

FIG. 1 is a perspective view of a packaging box according to an embodiment of the present invention. FIG. 2 is an exploded perspective view of the packaging box shown in FIG. 1. FIG. 3 is a bottom perspective view of an internal box and a slide pad of the packaging box illustrated in FIGS. 1 and 2.

Referring to FIGS. 1 through 3, a packaging box 100 according to an embodiment of the present invention includes an external box 110, an internal box 120, a slide pad 130, and a guide 140.

The external box 110 has a receiving space therein and includes a receiving part 111 and a cover 112. The external box 110 may be formed of corrugated cardboard, but is not limited thereto.

The receiving part 111 has a generally rectangular parallelepiped shape with an upper side being open. In one embodiment, the receiving part 111 has a pair of first side surfaces 111*a* (e.g., long side surfaces), a pair of second side surfaces 111*b* (e.g., short side surfaces), and a bottom surface 111*c* connecting the pair of first side surfaces 111*a* to the pair of second side surfaces 111*b*. The receiving part 111 is open at an upward-facing side. The cover 112 is removably coupled to an upper portion of the receiving part 111. The internal box 120 is receivable in the receiving part 111.

The cover 112 is coupled to the upper portion of the receiving part 111 to close or seal the inside of the receiving part 111. The cover 112 has a generally rectangular parallelepiped shape corresponding to that of the receiving part 111 and having a lower side being open. That is, the cover 112 has a pair of first side surfaces 112*a* (e.g., long side surfaces), a pair of second side surfaces 112*b* (e.g., short side surfaces), and a top surface 112*c* connecting the pair of first side surfaces 112*a* to the pair of second side surfaces 112*b*. In one embodiment, the first side surfaces 112*a* and the second side surfaces 112*b* of the cover 112 may have heights less than those of the first side surfaces 111*a* and the second side surfaces 111*b* of the receiving part 111. The cover 112 is open at a downward-facing side. According to one embodiment, a lower portion of the cover 112 is removably coupled to the upper portion of the receiving part 111 to form the external box 110.

The internal box 120 is receivable inside the external box 110 and has a receiving space therein. That is, the internal box 120 is covered by the cover 112 after the internal box 120 is received into the receiving part 111 of the external box 110. The internal box 120, in one embodiment, includes a body 121 and an upper cover 126. In one embodiment, the body 121 and the upper cover 126 may be integrally formed as one body. The internal box 120 may be formed of corrugated cardboard, but is not limited thereto.

The body 121 has a generally rectangular parallelepiped shape with an upper side being open. That is, the body 121 has a front surface 122, a rear surface 123 facing the front surface 122, a pair of side surfaces 124 connecting the front surface 122 to the rear surface 123, and a bottom surface 125 connecting the front surface 122, the rear surface 123, and the pair of side surfaces 124 to each other.

In one embodiment, a lower hole 121*a* (see FIG. 3) is defined in the bottom surface 125 of the body 121. The lower hole 121*a* is an opening through which a product 150 received in the internal box 120 may be removed to the outside. In use, the lower hole 121*a* may be closed by the slide pad 130 for holding the product 150 in the internal box 120.

In one embodiment, a pad gap 121*b* is defined at or near a portion where the front surface 122 and the bottom surface 125 of the body 121 are joined with each other. The pad gap 121*b* is a gap into which the slide pad 130 is coupled, or slidably inserted. When the slide pad 130 is coupled to, or slidably inserted into, the pad gap 121*b*, the lower hole 121*a* is closed by the slide pad 130. Conversely, when the slide pad 130 is separated from, or slidably removed from, the pad gap 121*b*, the lower hole 121*a* is opened.

In one embodiment, wing gaps 121*c* are defined at or near portions where the front surface 122 and the side surfaces 124 of the body 121 are joined with each other. The wing gaps 121*c* are gaps to which wing parts 128*a* of the upper cover 126 are coupled, or inserted into, respectively. Since the wing parts 128*a* may be respectively coupled to, or inserted into, the wing gaps 121*c*, a front portion of the upper cover 126 may be fixedly coupled to the body 121.

The upper cover 126 covers the open upper side of the body 121. The upper cover 126, in one embodiment, includes a first surface 127 and a second surface 128.

The first surface 127 is connected to the rear surface 123 of the body 121 to cover the open upper side of the body 121. The second surface 128 is connected to the first surface 127 and covers the front surface 122 of the body 121. The wing parts 128*a* are disposed on both sides of the second surface 128. The wing parts 128*a* are respectively coupled to (e.g., removably inserted into) the wing gaps 121*c* disposed on the side surfaces 124 of the body 121 to allow a front portion of the upper cover 126 to be coupled to the body 121.

The slide pad 130 is coupled to (e.g., removably slidably inserted into) the pad gap 121*b* defined in the body 121. The slide pad 130, in one embodiment, has an approximately "ㄴ" shape, or "L" shape. In one embodiment, the slide pad 130 has a first surface 131 and a second surface 132. The slide pad 130 may be formed of corrugated cardboard, but is not limited thereto.

The first surface 131, in one embodiment, is directly inserted into the pad gap 121*b* and coupled to the bottom surface 125 of the body 121. That is, in one embodiment, the first surface 131 closes the lower hole 121*a* defined in the bottom surface 125 of the body 121. Thus, the first surface 131 may have a size larger than a perimeter size of the lower hole 121*a*.

The second surface 132 is connected to the first surface 131 and coupled to the front surface 122 of the body 121. In one embodiment, a handle hole 132*a* is defined in the second surface 132. Thus, a user may easily couple or separate, or slidably insert or remove, the slide pad 130 to or from the pad gap 121*b*.

The guide 140, according to one embodiment, is disposed in the internal box 120 and has a plurality of partitions. That is, the guide 140 is disposed on the body 121 of the internal box 120. The product 150 may be received between partitions of the plurality of partitions. According to embodiments of the present invention, the product 150 is not limited to a specific kind of product. For example, the product 150 may include any product receivable between the partitions. In one exemplary embodiment, the product 150 is a battery cell and will be referred to as such hereinafter.

The guide 140 aligns one or more battery cells 150 in the internal box 120, and also, the guide 140 separates the battery cells 150 from each other to prevent or substantially prevent the battery cells 150 from being bumped against each other. The guide 140 may be formed of corrugated cardboard, but is not limited thereto.

A process of disassembling a packaging box according to an embodiment of the present invention will now be described.

Figure 4A:
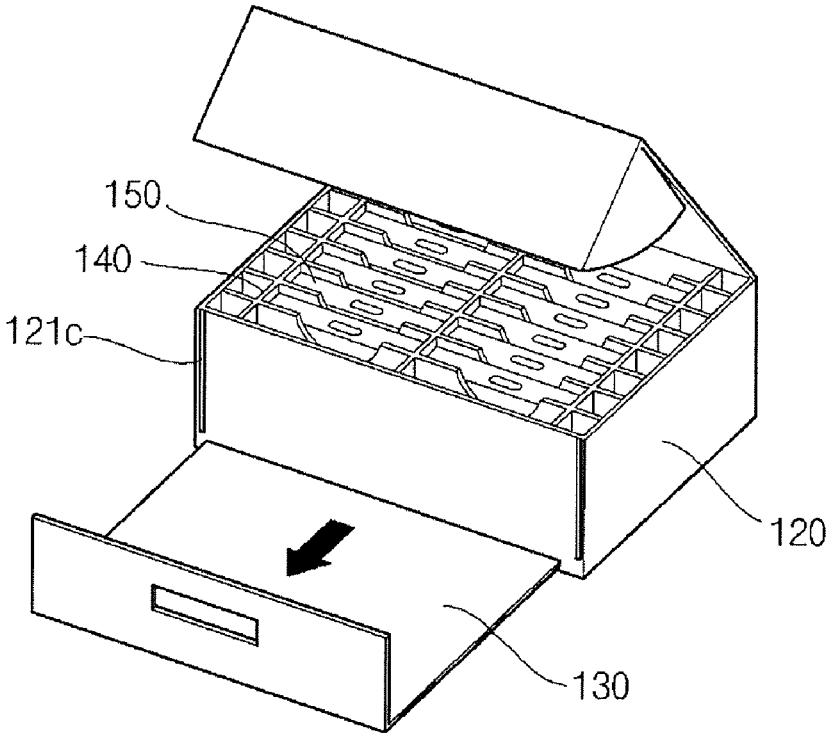
FIGS. 4A and 4B are perspective views illustrating a process of disassembling a packaging box according to an embodiment of the present invention.
Figure 4B:
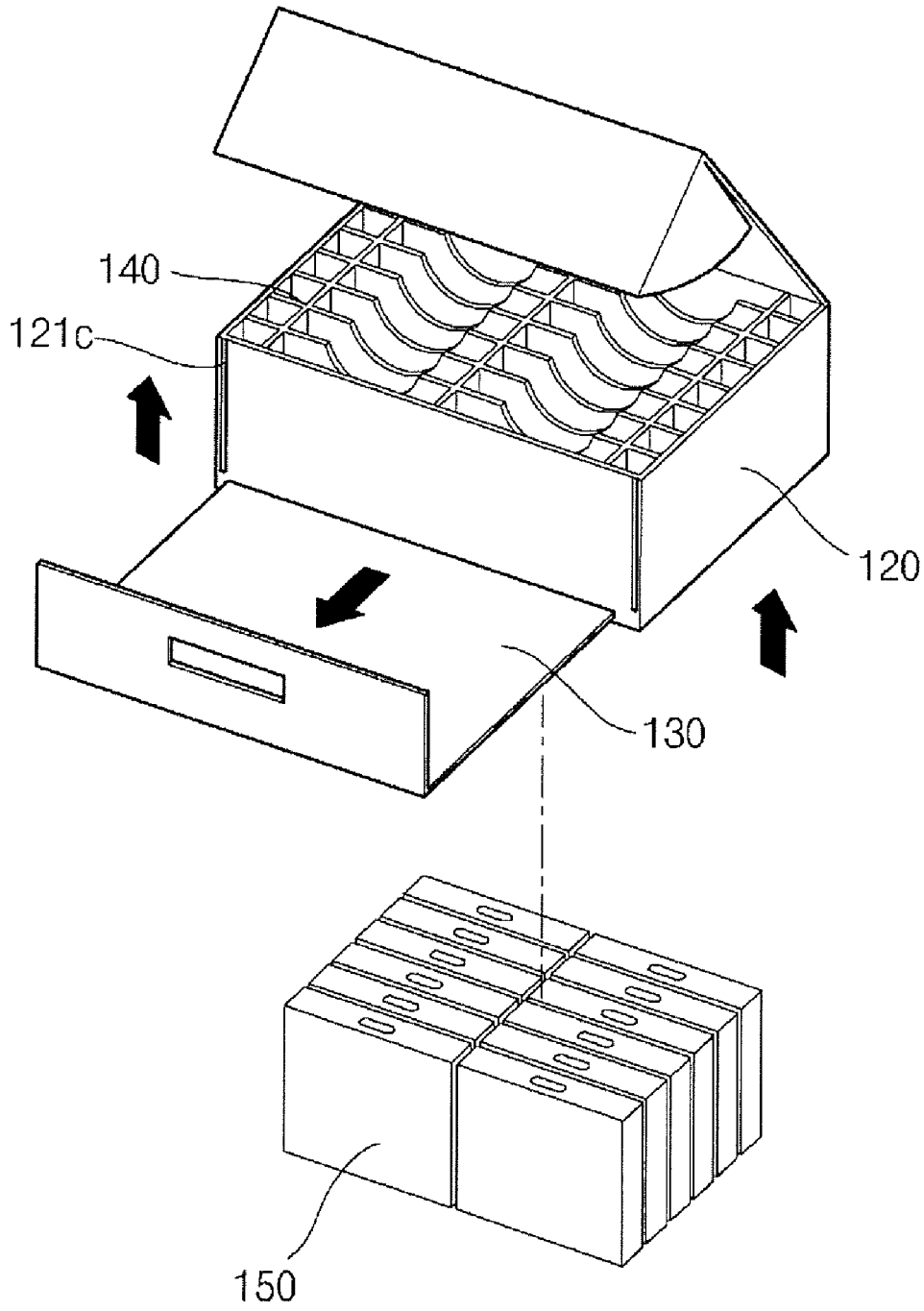

FIGS. 4A and 4B are perspective views illustrating a process of disassembling the packaging box 100 according to an embodiment of the present invention.

Referring to FIG. 4A, according to one embodiment, the external box 110 of the packaging box 100 is removed, and then, the upper cover 126 of the internal box 120 is opened. Then, the handle hole 132*a* is pulled to separate, or slidably remove, the slide pad 130 from the internal box 120.

Next, referring to FIG. 4B, after the slide pad 130 is separated from the internal box 120, when the internal box 120, the slide pad 130, and the guide 140 are together lifted upward, the battery cells 150 remain unlifted. That is, since the slide pad 130 is separated from the internal box 120 to open the lower hole 121*a*, the battery cells 150 may be separated from the packaging box 100.

As described above, since the packaging box 100 according to an embodiment of the present invention includes the slide pad 130, the packaging box 100 may be easily disassembled.

Also, since the packaging box 100 according to an embodiment of the present invention includes the slide pad 130, the plurality of battery cells 150 may be easily taken out of, or removed from, the packaging box 100.

A packaging box according to another embodiment of the present invention will now be described.

Figure 5:
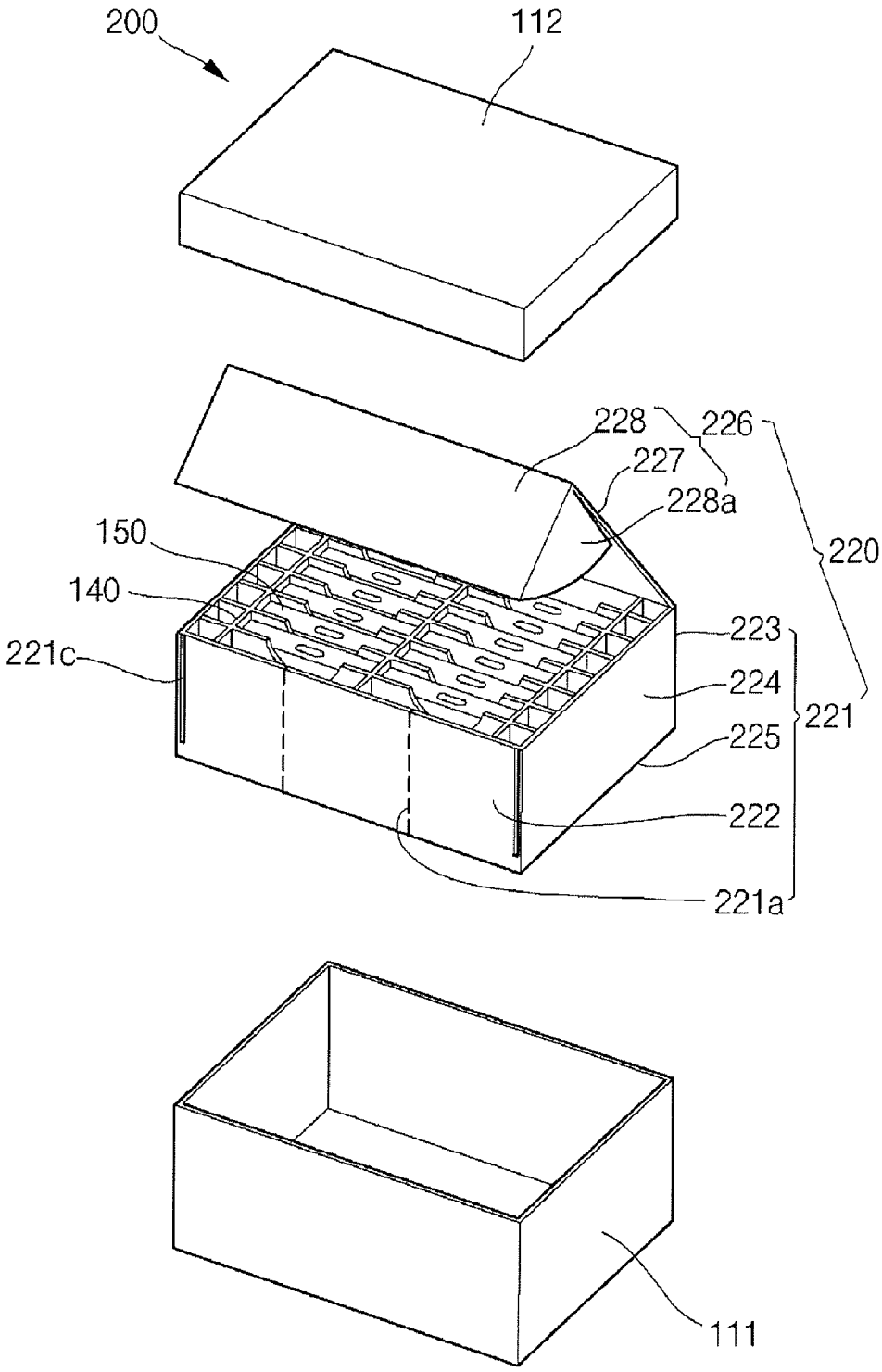
FIG. 5 is an exploded perspective view of a packaging box according to another embodiment of the present invention.
Figure 6:
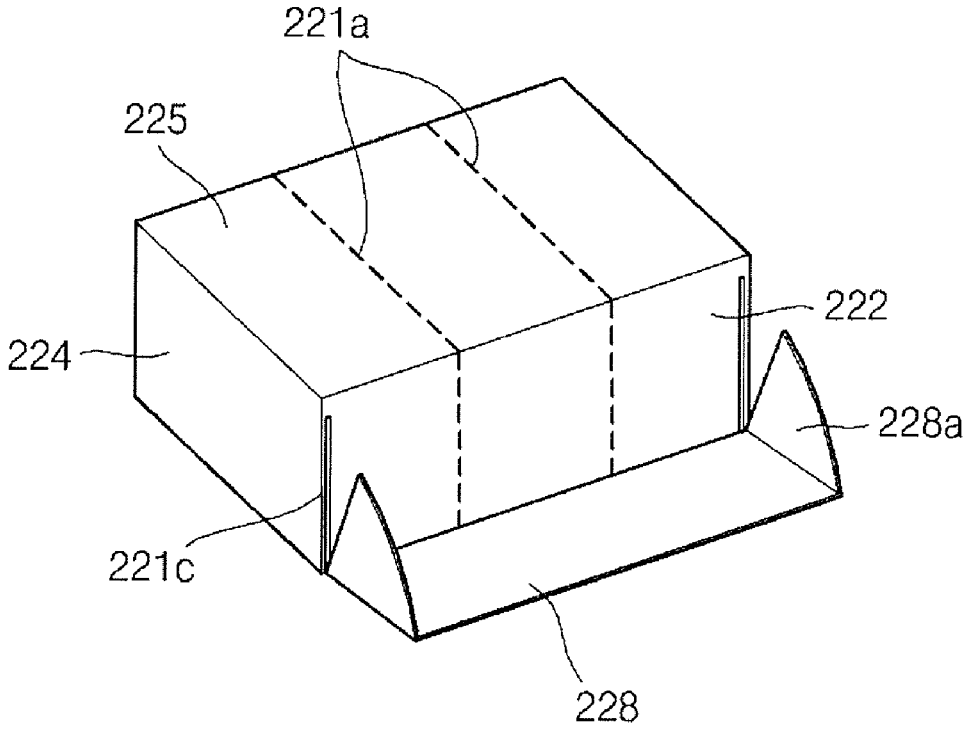
FIG. 6 is a bottom perspective view of an internal box of the packaging box of FIG. 5.

FIG. 5 is an exploded perspective view of a packaging box 200 according to another embodiment of the present invention. FIG. 6 is a bottom perspective view of an internal box 220 of the packaging box 200.

The packaging box 200 according to an embodiment of the present invention is similar to the packaging box 100 described above. Therefore, only components and structures of the packaging box 200 which differ from the packaging box 100 will be described below, and description of the same components or features will not be repeated.

Referring to FIGS. 5 and 6, the packaging box 200 includes the external box 110, the internal box 220, and the guide 140.

The internal box 220 is receivable inside the external box 110 and has a receiving space therein. That is, the internal box 220 is received into the receiving part 111 of the external box 110. The internal box 220, in one embodiment, includes a body 221 and an upper cover 226.

The body 221 has a generally rectangular parallelepiped shape with an upper side being open. That is, in one embodiment, the body 221 has a front surface 222, a rear surface 223 facing the front surface 222, a pair of side surfaces 224 connecting the front surface 222 to the rear surface 223, and a bottom surface 225 connecting the front surface 222, the rear surface 223, and the pair of side surfaces 224 to each other.

In one embodiment, one or more dotted lines 221*a* are disposed on the front surface 222 and the bottom surface 225 of the body 221. In one embodiment, as shown in FIGS. 5 and 6, two dotted lines 221*a* are provided, and will be described below. However, embodiments of the present invention are not limited thereto, and in other embodiments, any suitable number of dotted lines 221*a* may be provided. The dotted lines 221*a*, in one embodiment, are spaced a predetermined distance from each other. Also, in one embodiment, the dotted lines 221*a* extend from the front surface 222 of the body 221 to the bottom surface 225. The dotted lines 221*a* are guide lines, such as perforated lines, for tearing the internal box 220 in a constant direction.

In one embodiment, the upper cover 226 is the same or substantially the same as the upper cover 126 of the packaging box 100, and therefore, a detailed description thereof will be omitted. The upper cover 226 may include, for example, a first surface 227 similar to the first surface 127, a second surface 228 similar to the second surface 128, and wing parts 228*a* insertable into wings gaps 221*c* of the body 221 and similar to the wing parts 128*a*.

A process of disassembling the packaging box 200 according to another embodiment of the present invention is described below.

FIGS. 7A through 7D are perspective views illustrating a process of disassembling the packaging box 200 according to another embodiment of the present invention.

Figure 7A:
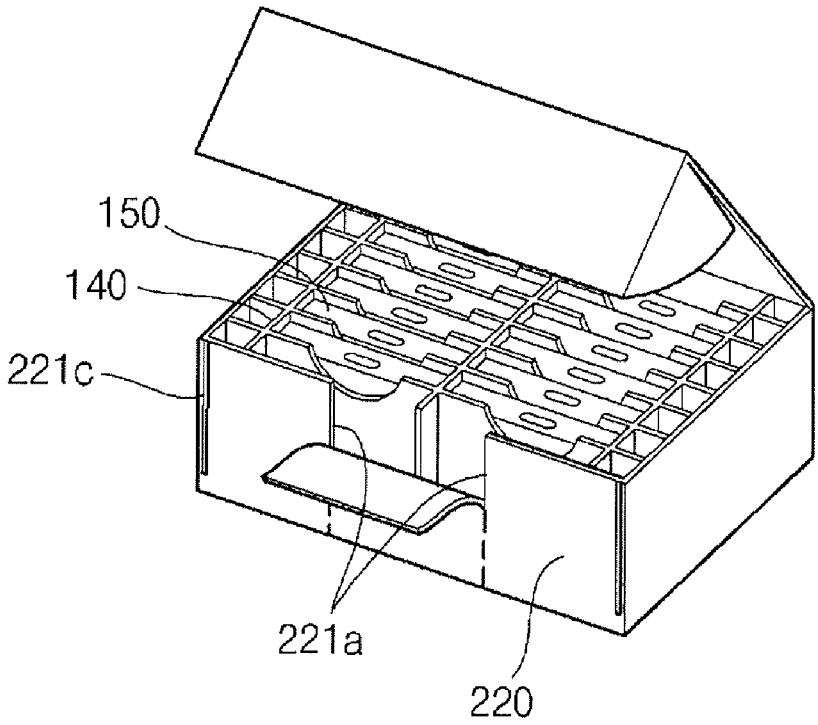
FIGS. 7A to 7D are perspective views illustrating a process of disassembling a packaging box according to another embodiment of the present invention.

Referring to FIG. 7A, the external box 110 of the packaging box 200 is removed, and then, the upper cover 226 of the internal box 220 is opened. When the front surface 222 of the body 221 disposed between the dotted lines 221*a* is pulled, the front surface 222 of the body 221 is torn along the dotted lines 221*a*.

Figure 7B:
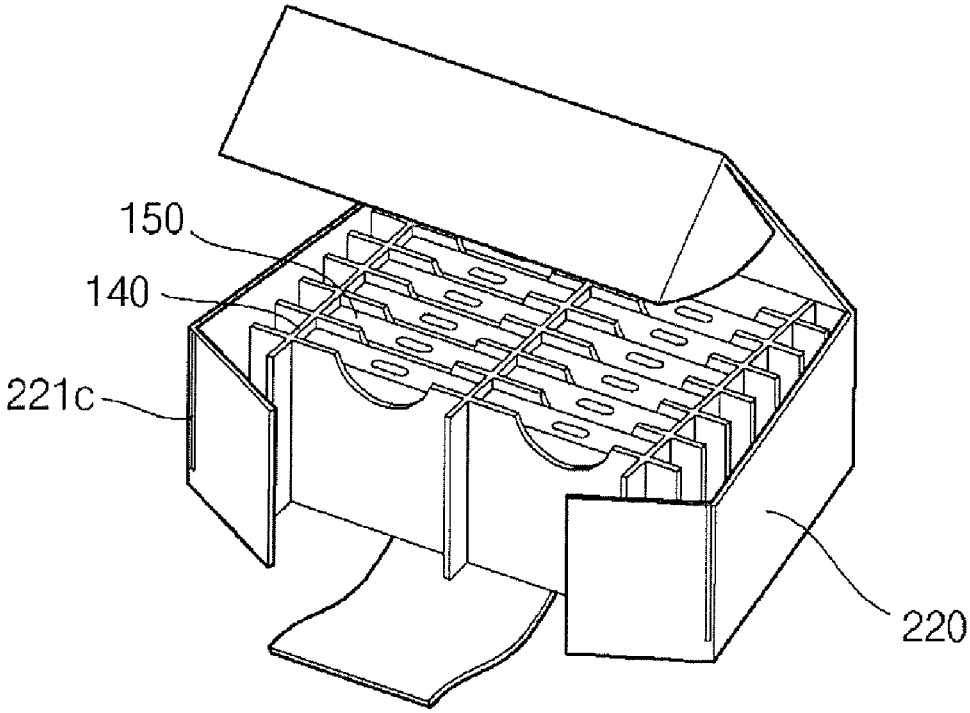
Figure 7C:
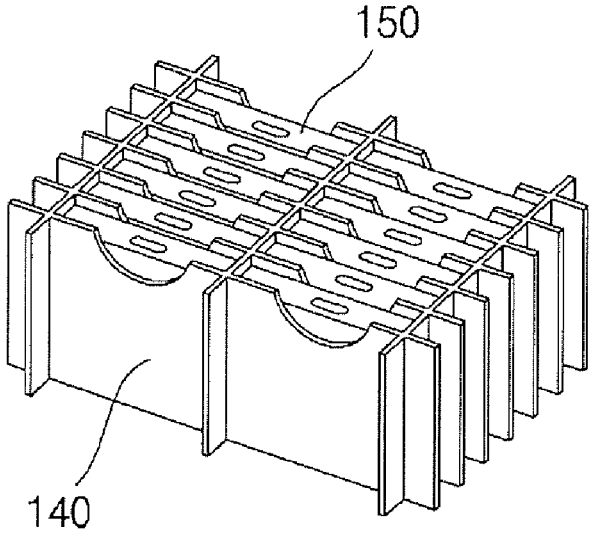

Referring to FIGS. 7B and 7C, when a user grasps and pulls the side surfaces 224 of the body 221 in both side directions, the bottom surface 225 of the body 221 is torn along the dotted lines 221*a*. Then, when the user grasps the upper cover 226 and pulls the internal box 220 toward the rear surface 223 of the body 221 to remove the internal box 220, only the guide 140 and the battery cells 150 remain.

Figure 7D:
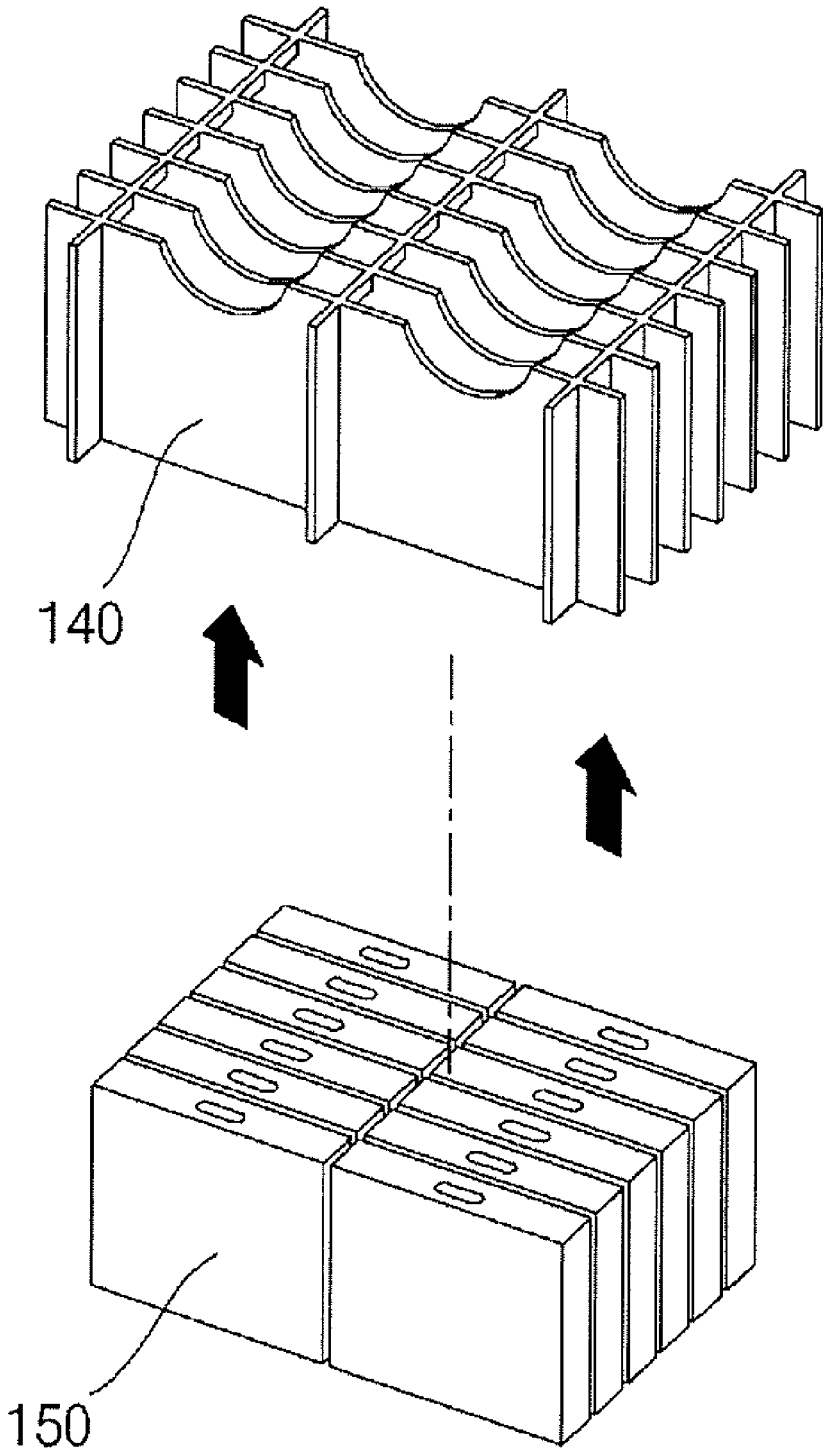

Referring to FIG. 7D, when the guide 140 is lifted upward, the battery cells 150 remain unlifted. That is, the internal box 220 is torn along the dotted lines 221*a* to separate the battery cells 150 from the packaging box 200.

As described above, in the packaging box 200, the dotted lines 221*a* may be disposed on the internal box 220 to easily disassemble the packaging box 200.

Also, in the packaging box 200, since the dotted lines 221*a* are disposed on the internal box 220, the battery cells 150 may be easily taken out of the packaging box 200.

Since the packaging box 100 according to one exemplary embodiment of the present invention includes the slide pad 130, the packaging box 100 may be easily disassembled, and also the battery cells 150 may be easily taken out of the packaging box 100.

Also, in the packaging box 200 according to another exemplary embodiment of the present invention, since the dotted lines 221*a* are disposed on the internal box 220, the packaging box 200 may be easily disassembled, and also the battery cells 150 may be easily taken out of the packaging box 200.

While some exemplary embodiments have been described herein and although specific terms are employed, they are used and are to be interpreted in a generic and descriptive sense only, and not for purpose of limitation. Accordingly, it will be understood by those of ordinary skill in the art that various changes in form and details may be made without departing from the spirit and scope of the present invention as set forth in the following claims.

What is claimed is:

1. A packaging box comprising:

an external box having a receiving space therein, the external box comprising a receiving part and an external cover removably coupleable to the receiving part;

an internal box removably receivable in the receiving space of the external box, the internal box having a receiving space therein and comprising a body having an opening defined in a lower surface of the body; and a slide pad slidably coupleable to a lower portion of the internal box, the slide pad being slidable relative to the opening, wherein a plurality of battery cells is receivable in the receiving space of the internal box.

2. The packaging box as claimed in claim 1, further comprising a guide arranged in the internal box and comprising a plurality of partitions, wherein the plurality of battery cells is received into the guide.

3. The packaging box as claimed in claim 1, wherein the internal box further comprises an internal cover covering an open upper side of the body, the body and the internal cover being integrally formed.

4. The packaging box as claimed in claim 3, wherein the internal cover comprises:

a first surface connected to a rear surface of the body and covering the open upper side of the body; and a second surface connected to the first surface and covering a front surface of the body opposite the rear surface.

5. The packaging box as claimed in claim 3, wherein the opening is defined in the lower surface of the body opposite the open upper side.

6. The packaging box as claimed in claim 3, wherein the internal cover comprises a wing part coupleable to a side surface of the body, and wherein a wing gap is defined in the body, the wing part being insertable in the wing gap.

7. The packaging box as claimed in claim 3, wherein a pad gap is defined in the body, the slide pad being removably insertable in the pad gap.

8. The packaging box as claimed in claim 1, wherein the slide pad comprises:

a first surface slidably coupleable to the lower portion of the internal box; and a second surface coupled to a front surface of the internal box, wherein a handle hole is defined in the second surface.

9. A packaging box comprising:

an external box having a receiving space therein, the external box comprising a receiving part and a cover removably coupleable to the receiving part;

an internal box receivable in the receiving space of the external box, the internal box having a receiving space therein; and at least one perforated line on a front surface and a bottom surface of the internal box, the at least one perforated line continuously extending from an upper edge of the front surface to a lower edge of the front surface and to the bottom surface, wherein a plurality of battery cells is receivable in the receiving space of the internal box.

10. The packaging box as claimed in claim 9, further comprising a guide arranged in the internal box and comprising a plurality of partitions, wherein the plurality of battery cells is received into the guide.

11. The packaging box as claimed in claim 9, wherein the internal box comprises a body and an internal cover covering an open upper side of the body, the body and the internal cover being integrally formed.

12. The packaging box as claimed in claim 11, wherein the internal cover comprises:

a first surface connected to a rear surface of the body and covering the open upper side of the body; and a second surface connected to the first surface and covering a front surface of the body opposite the rear surface.

13. The packaging box as claimed in claim 11, wherein the internal cover comprises a wing part coupleable to a side surface of the body, and wherein a wing gap is defined in the body, the wing part being insertable in the wing gap.

* * * * *